US006213924B1

(12) United States Patent
Kaiyoorawongs

(10) Patent No.: US 6,213,924 B1
(45) Date of Patent: Apr. 10, 2001

(54) TORSO TWISTING EXERCISE APPARATUS AND METHOD

(76) Inventor: Chaipan Kaiyoorawongs, 3372 Webber St., Sarasota, FL (US) 34239

( * ) Notice: Subject to any disclaimer, the term of this patent is extended or adjusted under 35 U.S.C. 154(b) by 0 days.

(21) Appl. No.: 09/419,984

(22) Filed: Oct. 18, 1999

(51) Int. Cl.[7] ..... A63B 23/04

(52) U.S. Cl. ..... 482/146; 482/79

(58) Field of Search ..... 482/146, 145, 482/147, 130, 142, 79; 74/591.4, 57

(56) References Cited

U.S. PATENT DOCUMENTS

| | | | | |
|---|---|---|---|---|
| 4,989,860 | * | 2/1991 | Iam et al. | 482/146 |
| 5,062,630 | * | 11/1991 | Nelson | 482/146 |
| 5,527,253 | * | 6/1996 | Wilkinson et al. | 482/147 |
| 5,879,276 | * | 3/1999 | Miller | 482/146 |
| 6,042,521 | * | 3/2000 | De Giorgis | 482/79 |

* cited by examiner

*Primary Examiner*—Jerome W. Donnelly
(74) *Attorney, Agent, or Firm*—Dorothy S. Morse

(57) ABSTRACT

Exercise apparatus and method of use involving a stationary base member, a freely rotatable rectangular foot support centrally attached to the top surface of the base member and having a width-adjustable foot placement area for positioning an operator's feet in line with his or her shoulders during use, the foot support also having an upper surface that is angled laterally upward from its center; as well as a height-adjustable upper torso support pivotally attached to one end of the base member that remains stationary during use and by which an operator can support his or her upper body in a substantially stationary position while the operator's lower torso and legs are alternatively made to rotate clockwise and counterclockwise. The angled foot support allows the operator to stretch and strengthen arm, shoulder, hip, back, leg, and foot muscles as the operator's weight is shifted alternatively from the inside bottom surface of one foot to the inside bottom surface of the other foot while his or her lower torso and legs are repetitively rotated back and forth. In a slightly bent knee position, operator movement duplicates that required in many sports and thereby will enhance operator balance, agility, and forward thrusting power for improved sports performance. Applications may include, but are not limited to, general improvement in overall torso flexibility, as well as training and warm up exercise for athletic activities, such as golf, tennis, basketball, football, baseball, softball, soccer, boxing, skating, skiing, and dancing.

20 Claims, 3 Drawing Sheets

2
20
34
36
38
40
42
44
46
48
50
52
54
56
58
60
62
64
4
5
6
8
10
12
14
16
18
22
23
24
26
28
30
32

TORSO TWISTING EXERCISE APPARATUS AND METHOD

BACKGROUND

1. Field of the Invention

This invention relates to exercise devices, specifically to an exercise apparatus and method of use, the apparatus comprising a stationary base member; a freely rotatable rectangular foot support centrally attached to the top surface of the base member and having a foot placement area that is adjustable in width to align an operator's feet with his or her shoulders during use, the foot support also having an upper surface that is angled laterally upward from its center to place a major portion of the operator's weight on the inside portion of each foot during foot support rotation; as well as a height adjustable upper torso support pivotally attached to the top surface of the base member near to one of its ends that remains stationary during foot support rotation and by which an operator can support his or her upper body in a substantially stationary position while the operator's lower torso and legs are alternatively made to rotate clockwise and counterclockwise. The apparatus allows the operator to stretch and strengthen arm, shoulder, hip, back, leg, and foot muscles as the operator's weight is shifted alternatively from the inside bottom surface of one foot to the inside bottom surface of the other foot while his or her lower torso and legs are rapidly, smoothly, and repetitively rotated back and forth through an arc of approximately 180° in each direction. In a slightly bent knee position, operator movement during use of the present invention simulates that required in many sports activities and gives athletes a high number of muscle movement repetitions in a short period of time to condition and tone targeted muscles to allow the muscles to rapidly achieve the level of experience necessary for improved sports performance, as well as improvement in operator balance, agility, and forward thrusting power. Applications may include, but are not limited to, use to achieve increased torso flexibility, as well as conditioning and warm up exercise for athletic activities, such as golf, tennis, basketball, football, baseball, softball, soccer, boxing, skating, skiing, and dancing.

2. Background—Description of Prior Art

To reach optimum performance in a chosen sport, overall athlete conditioning and endurance are important. However, each sport places added demands on particular groups of muscles. For example, in basketball extra demand is placed upon the wrist flexors, hamstrings, hip flexors, biceps, and calves; in swimming extra demand is placed upon the biceps, wrist flexors, chest, quadriceps, neck rotators, and shoulder rotators; in jogging the extra demand is placed upon the hamstrings, hip flexors, quadriceps, hip flexors, and lower back; and in golf the extra demand is placed upon the biceps, wrist flexors, trunk rotators, hip rotators, lower back, rib cage, neck flexors, neck extensors, and hip flexors. It is the muscles used most often to which the athlete must pay particular attention during training to obtain the extra power and strength needed for outstanding achievement in the chosen sport, as well as to remain injury free. The strength and power of shoulders and arms, as well as torso flexibility, are important to success in many athletic activities, including golf, tennis, basketball, football, baseball, softball, soccer, boxing, skating, skiing, and dancing. An athlete with enhanced torso flexibility is more readily able to follow through in a golf swing, in throwing a football or baseball, when at bat, when landing a boxing jab or punch, or during a basketball free throw. Exercise apparatus that closely duplicates actual athlete movement during a chosen sport is particularly useful during muscle conditioning for providing the strength and power later needed during a sports performance.

Torso twisting exercise devices are known, however they typically have a small rotatable upper surface upon which the operator must stand that does not permit the operator's feet to be aligned with his or her shoulders during lower torso and leg rotation. When the operator's feet are not so aligned, the operator's body will tend to sway during lower torso rotation and the athlete's muscles will not be trained to achieve optimum performance and power. Also, many prior art torso twisting devices have too much friction that prevents them from providing the smooth freely twisting motion in an arc of 180° or more in each direction that would allow the operator to optimally stretch and condition his or her arm, shoulder, hip, back, leg, and foot muscles for maximum power during swinging, throwing, punching, and related sports activities.

In contrast, the freely rotating foot support of the present invention has a large width-adjustable upper surface usable by operators of almost all statures and foot sizes. Short walls upwardly depending from the perimeter of its upper surface serve multiple purposes. They promote operator safety by helping to keep the operator's feet from inadvertently moving off of the upper surface during operator mounting of and dismount from the apparatus, as well as during lower torso and leg rotation. Each of the four walls extends around one of the corners of the foot support and is separated from adjacent walls by an opening slightly larger than the width dimension of the upper torso support. The centrally positioned and opposed wall openings allow the upper torso support in its collapsed position to keep the foot support from freely rotating during transport and storage. In addition, the foot support walls also provide a means for adjustably narrowing the width of the upper surface to customize it so that successive operators of differing stature are each able to achieve the optimum stability and balance during lower torso and leg rotation for maximum torso twisting effect. Operators having a very large stature might be able to use the foot support walls themselves as a stabilizing hard surface for the outside edges of their feet during lower torso and leg rotation to help them in maintaining optimum balance as well as continual alignment of feet and shoulders. However, smaller operators relying on the same walls for foot stabilization would not have their feet aligned with their shoulders. Therefore, the preferred embodiment of the present invention provides six or seven sets of opposed vertical grooves on the inside surfaces of the walls in front of and behind each operator foot, as well as two rigid bars having a thickness dimension slightly smaller than the width of the grooves. Immediately prior to use, if the operator needs a narrower upper surface for stability and optimum foot placement, the operator would place one of the rigid bars on each side of the foot support within the opposed grooves that most closely line up with the outside edges of the operator's feet in their desired shoulder-aligned position. The upper surface of its foot support which is laterally angled upward, further distinguishes the present invention from prior art torso twisting exercise devices. In the present invention both sides of the upper surface of the foot support are laterally angled upward approximately 10–20° to place both of the operator's feet in positions that duplicate the positions athletes often encounter when their body weight is shifted from the inside surface of the ball of one foot to the inside surface of the ball of the other foot. No exercise device is known that provides all of its advantages of the present invention, or functions in the same manner as the present invention to accomplish the objectives stated herein.

SUMMARY OF INVENTION—OBJECTS AND ADVANTAGES

It is the primary object of this invention to provide an exercise device with a large freely rotatable foot support that is laterally angled upward to duplicate positions that athletes encounter during sports activity wherein their body weight is caused to shift from the inside surface of the ball of one foot to the inside surface of the ball of the other foot and thereby create the type of repetitive movement necessary for enhanced torso flexibility, agility, strength, and forward thrusting power of those using it. It is also an object of this invention to provide an exercise device that conditions and tones an athlete to twist with more power while swinging a bat or racket, throwing a ball, lunging forward, ducking sideways or backward, and throwing a punch or jab. It is also a further object of this invention to provide an exercise device that gives athletes a high number of muscle movement repetitions in a short period of time to allow targeted muscles to rapidly achieve the level of experience necessary for improved sports performance. A further object of this invention is to provide an exercise device with a width-adjustable foot support for use by people of varying stature and foot size that is sufficiently large so that those using it can align their feet with their shoulders during lower torso and leg rotation for rotation without sway, but which also assists in keeping the operator's feet in such an optimum position during use. It is also an object of this invention to provide an exercise device that has an upper torso support with elongated handles that helps an operator maintain his or her upper body in a substantially stationary position during lower torso and leg rotation. It is a further object of this invention to provide an exercise device in which the upper torso support can be adjusted vertically in height, as well as to any angle between horizontal and vertical positions, for optimum operator comfort in addition to the ability to fold compactly for convenient transport and storage. It is also an object of this invention to provide an exercise device that is simple, fun, and easy to use, and one that is readily portable by one adult of average stature and strength. It is a further object of this invention to provide an exercise device that is solidly built for operator safety, made from durable materials for extended use without refurbishment, and includes a stable base structure capable of resisting movement during foot support rotation.

As described herein, properly manufactured and used, the present invention would provide an exercise device that enhances the torso flexibility of an operator for improved performance in athletic activities such as boxing and tennis which require rapid weight transfer to duck and avoid the jab of an opponent or to achieve a quick forward response to an opponent's lob which lands close to the net, as well as in golf to achieve a powerful swing that gains a fairway distance advantage over an opponent. The present invention also provides enhanced operator arm and shoulder muscle conditioning for improved operator agility, strength, and forward thrusting power. Its laterally angled and width-adjustable foot support allows an athlete to better duplicate the actual movement experienced during sports activity than prior art torso twisting devices which have rotatable surfaces which are not laterally angled upward, are too small to permit the operator's feet to be in alignment with his or her shoulders, or have too much friction to permit a smooth twisting motion. The H-shaped base member of the preferred embodiment of the present invention is both wider and longer than its angled foot support, substantial in weight, and has an essentially rectangular central web extending between opposed elongated anchors. The anchors are attached to the ends of the web and extend symmetrically beyond both of the side surfaces of the web to provide it with a stabilizing outrigger type of support. Caps attached to the opposite ends of each elongated anchor, and that are made from a gripping, high-friction type of material such as rubber, also help the base member to remain in a fixed position during foot support rotation. A bearing cartridge positioned between the foot support and the base member, and into which a downward extension of the foot support is secured, permits the foot support to be freely rotatable.

In the preferred embodiment of the present invention the foot support is rectangular in configuration, the ends of its upper surface are laterally angled upward approximately 10–20° from its center, its width dimension is slightly shorter than the length dimension of the base member, and its length dimension is approximately one-third of the base member's length dimension. Short walls upwardly depending from the upper surface of the foot support, in and around the corners of the foot support, promote operator safety by helping to keep the operator's feet from inadvertently slipping off the upper surface during mounting and dismounting of the apparatus as well as during lower torso and leg rotation. The walls also provide a means of adjustably narrowing the width of the upper surface to customize it so that each successive operator can achieve optimum stability and balance during lower torso and leg rotation. Spaced-apart sets of opposed vertical grooves positioned on the inside surfaces of the walls in front of and behind operator feet guide the insertion of rigid bars that provide a hard surface against which the outside edge of each operator's foot can press during lower torso and leg rotation so that the operator's feet remain aligned with his or her shoulders at all times during use for maximum torso twisting effect. Brackets attached to the base member in an out-of-the-way position, such as on the outside surface of the anchor remote from the lower vertical support member, allow the width-adjusting rigid bars to be conveniently stored with the device when not needed for use. Using the bars to provide a rigid surface on the outside of each operator foot, and against which the foot can push during foot support rotation, permits the operator to achieve the stability and balance necessary for a fast-paced but smooth rotational motion between clockwise and counterclockwise directions. Optionally a mat made from a gripping material such as rubber, or having a non-slip surface texture, or both, can be placed on the upper surface of the foot support during use as a further means of maintaining operator feet in the optimum position desired during lower torso and leg rotation.

The present invention also has a vertically extending, T-shaped height-adjustable upper torso support with an elongated handle laterally extending from each of its sides near to its distal end. Sleeves made from non-slip material may be optionally placed over the handles to improve the grip of an operator during lower torso and leg rotation. The angle of the upper torso support relative to the base member is also adjustable. As a result the upper vertical support member can be pivoted into a position substantially parallel to the base member for compact transport and storage, as well as being placed into a variety of near vertical orientations to accommodate operators of differing stature. The upper torso support has an upper vertical support member the bottom of which is telescopingly engaged within the top opening of a lower vertical support member for height adjustment, while the bottom of the lower vertical support member is pivotally connected to a U-shaped bracket that is secured to the top surface of one end of the central web. It is contemplated that the arms of each operator should be approximately waist high during lower torso and leg rotation for optimum twisting effect without sway. Wheels attached to the outside surface of the anchor that is adjacent to the upper torso support, allow easy transport of the present invention form one location to another. The wheels are positioned so as not to engage the floor surface below them during foot support rotation, but to be available for use when the present invention is upended like a dolly or hand truck.

The present invention is simple to use and beginners are at no disadvantage. Once an operator uses the rotating knobs on the upper torso support to adjust the angle of the lower vertical support member relative to the base member for maximum operator comfort, as well as adjust the height of the upper vertical support member so that the handles are approximately waist high, the rigid bars stored within the out-of-the-way brackets attached to the base member, if needed to align the operator's feet with his or her shoulders, would be positioned within the corresponding opposed grooves of the foot support that mark the desired operator foot position. The bars provide a hard surface against which the outside edge of each operator foot can press for maximum operator balance and stability during lower torso and leg rotation. To mount the present invention, the operator would stand centrally behind the rear anchor, lean over the foot support, and place his or her hands securely onto the elongated handles. While using the handles for support of the upper torso, the operator would then place one foot at a time near the center of the freely rotating foot support. Thereafter, the operator would move each foot one at a time from the center of the foot support into a position where its outer edge is in contact with one of the rigid bars. Then, with knees and arms in various bent positions or straight, depending upon the sports activity movement the operator is attempting to simulate, the operator would begin twisting his or her lower torso from side to side to make the foot support alternatively rotate in clockwise and counterclockwise directions while the operator holds onto the handles to support the upper torso in a stationary substantially straightforward position. As the muscles and skin around the operator's waist become conditioned and toned from the repetition and the operator's torso flexibility improves, sustained rotation of the foot support 180° or more in each direction could be anticipated. During optimum use, the present invention gives athletes a high number of muscle movement repetitions in a short period of time that permits targeted muscles to rapidly achieve the level of experience necessary for improved sports performance. Use of the present invention for 15–20 minutes per day is recommended to improve as well as maintain a high level of torso flexibility, and thereby enhance operator balance as well as swinging, throwing, and forward thrusting power during various sports activities. To dismount the present invention, an operator would continue to grip the handles while moving one foot at a time from the angled upper surface to the center of the foot support. Thereafter, one foot at a time would be moved in a backward direction off the upper surface and onto the floor centrally behind the rear anchor. Once the operator's feet are clear of the apparatus, the operator's hands would be released from the handles.

The description herein provides preferred embodiments of the present invention but should not be construed as limiting its scope. For example, variations in the configuration of the base member as long as it provides a broad, stable anchoring for the foot support during its rotation; the type of materials used for manufacture of the base member, foot support, and vertically extending upper torso support; the number, size, configuration, and location of the wheels attached to the base member as long as they remain disengaged from the floor surface supporting the base member during foot support rotation; the type of material from which the handle sleeves and anchor caps are made; and the size and shape of the rotatable knob used for height adjustment of the upper torso support member as long as it is configured for easy operator manipulation, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

The present invention provides a torso twisting exercise device that improves the torso flexibility of an operator (not shown) for improved swinging, throwing, punching, and forward thrusting performance in a variety of sports activities. Its laterally angled foot support 20 allows athletes to better duplicate movement required during many sports activities than prior art torso twisting devices (not shown) since during lower torso and leg rotation with the present invention the operator's weight is shifted alternatively from the inside bottom surface of one foot to the inside bottom surface of the other foot, similar to the shift in weight experienced during a tennis swing, a boxing jab, the swing of a golf club, the swing of a baseball bat, the pitch of a softball or baseball, a soccer kick, or the forward throw of a football or basketball. Also, since the present invention has a foot placement area with an upper surface 24 that is adjustable in width, it allows the feet of an operator to be aligned with his or her shoulders during use for lower torso and leg rotation without sway. An operator can therefore use the present invention to incrementally stretch and strengthen arm, shoulder, hip, back, leg, and foot muscles and achieve a high number of muscle movement repetitions in a short period of time to condition and tone targeted muscles to cause those muscles to rapidly achieve the level of experience necessary for improved sports performance. Variations in operator position can be achieved through the bending of knees and arms where needed to better duplicate athlete movement in the sport in which improved performance is desired. For example, to improve a golf swing, the present invention would be used by the operator with substantially straight arms and slightly bent knees, whereas for improvement in tennis or baseball one might alternatively use substantially straight or bent arm positions.

Figures 1, 2, 3:
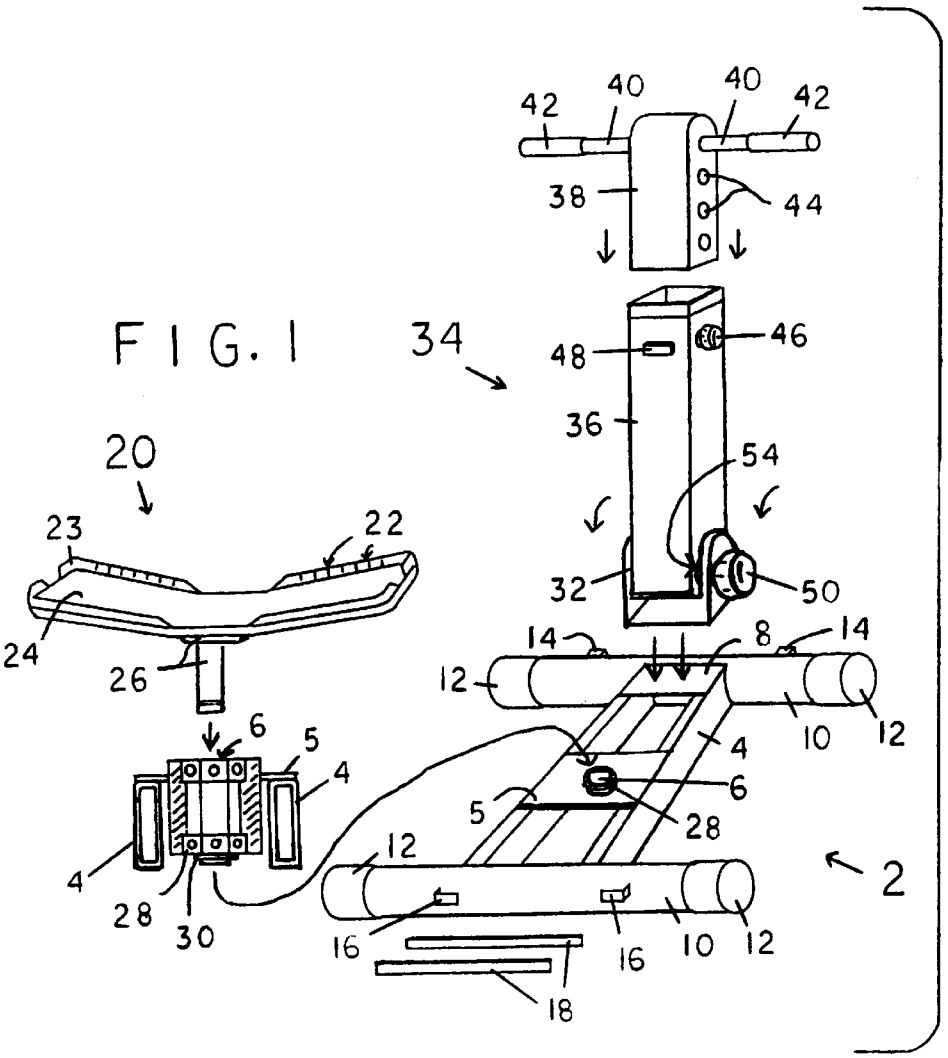
FIG. 1 is a perspective view of one preferred embodiment of the present invention having a freely rotatable foot support and an adjustable upper torso support both poised for attachment to a base member, the foot support having an upper surface that is angled laterally upward and opposed sets of grooves for upper surface width adjustment, with the upper torso support capable of being extended in height as well as pivotally moved relative to the base member from a collapsed horizontal position to a variety of substantially vertical positions.
FIG. 2 is an enlarged perspective view of one preferred embodiment of a height adjustment connection that places the upper and lower vertical support members in a fixed position relative to one another during operator use.
FIG. 3 is an enlarged sectional view of one preferred embodiment of a pivotal adjustment connection having a U-shaped bracket to secure the lower vertical support member to the base member.

FIG. 1 shows the preferred embodiment of the present invention having an essentially H-shaped base member 2, a vertically extending upper torso support 34, and a rotatable foot support 20 that turns freely in both clockwise and counterclockwise directions when properly mounted upon base member 2. FIG. 1 shows base member 2 having a substantially rectangular central web 4 extending between two opposed elongated anchors 10 positioned approximately perpendicular to web 4, each anchor 10 being attached to one end of web 4 so that a nearly identical portion of anchor 10 extends beyond each side of web 4 to provide a stabilizing outrigger type of function for the present invention during operator use. Although it is contemplated for web 4 to have either a solid or open framework type of construction, the preferred embodiment of web 4 has an open framework type of construction to make it lighter in weight for enhanced portability by a single adult of average strength and coordination. Web 4 also has a support plate 5 centrally attached to its top surface, a bearing cartridge 28 positioned centrally within support plate 5, and a central aperture 6 through the top surface of bearing cartridge 28 for insertion therein of the extension 26 downwardly depending front the bottom surface of foot support 20. It is contemplated for support plate 5 to be welded or bonded to web 4 in any manner that would provide a strong, durable connection therebetween. The sectional view insert within FIG. 1 below foot support 20 shows bearing cartridge 28 as it would be positioned between the opposed tubular sides of web 4, with a ring clamp 30 located immediately below bearing cartridge 28, ready to lock extension 26 squarely within bearing cartridge 28 for free rotation of foot support 20 during torso twisting use by an operator (not shown). The use of ring clamp 30 is not critical, and it is considered within the scope of the present invention for any type of fastener to be used which can secure extension 26 squarely within bearing cartridge 28 while also allowing free rotation of foot support 20.

FIG. 1 further shows a mounting platform 8 secured to one end of the top surface of web 4 for use in attaching U-shaped mounting bracket 32 to base member 2 for pivotal connection of upper torso support 34 to base member 2. It is contemplated for mounting bracket 32 to be welded or bonded to base member 2 in any manner that would provide a strong, durable connection therebetween. The length of web 4 should approximate but slightly exceed the width of foot support 20 so that foot support 20 can freely rotate relative to base member 2 during operator use without coming into contact with upper torso support 34, and so that operators also remain sufficiently close to upper torso support for easy access to handles 40. In addition, FIG. 1 shows the opposite ends of each anchor 10 each being covered by a cap 12. In the preferred embodiment it is contemplated for end caps 12 to be made from a non-skid durable material, such as rubber, that enhances the ability of base member 2 to remain in a stationary position during foot support 20 rotation. Although not shown, an adhesive or bonding agent could be used to secure caps 12 to anchors 10. Although the anchors 10 in FIG. 1 are shown to have a circular cross-section, it is considered within the scope of the present invention to also have anchors 10 with other cross-sectional configurations, such as square, octagonal, or triangular. FIG. 1 further shows wheels 14 attached to the anchor 10 adjacent to mounting platform 8, on the surface of that anchor 10 opposite to web 4. Wheels 14 permit the present invention to be collapsed into a compact configuration and upended like a two-wheeled dolly or hand truck (not shown) for easy transport. Wheels 14 do not engage the floor surface (not shown) below base member 2 while base member 2 is in its substantially horizontal usable position. Although not shown, casters or rollers could be used as a substitute for wheels 14. FIG. 1 also shows two brackets 16 and two rigid bars 18 poised for insertion into brackets 16 on the anchor 10 positioned remote from mounting platform 8, bars 18 being used to customize the width of foot support 20 for optimum foot placement by operators of differing stature. Although brackets 16 are shown in FIG. 1 on the surface of anchor 10 remote from web 4, the exact position for attachment of brackets 16 on that anchor 10 or elsewhere on the present invention is not critical, however, brackets 16 should be placed in an out-of-the-way position that does not interfere with foot support 20 rotation and adequately spaced apart from one another to support both bars 18 in a position that allows convenient operator insertion and removal. The means of attachment of brackets 16 to anchor 10 is not critical and brackets 16 can be welded to anchor 10 or attached by any other means that provides a secure and durable bond between brackets 16 and anchor 10.

FIG. 1 also shows foot support 20 having a substantially rectangular configuration with four upwardly depending side walls 23 in and around the corners of upper surface 24, with several vertical grooves 22 on the inside surfaces of each wall 23 positioned in front of the operator's feet. Although not shown, it is also contemplated in the preferred embodiment for the same number of opposed vertical grooves 22 to be on the inside surfaces of each wall 23 positioned behind the operator's feet. FIG. 1 also shows foot support 20 having an extension 26 downwardly depending from the central portion of its bottom surface and poised for engagement with bearing cartridge 28. It is contemplated for the longest dimension of foot support 20 to be its width and for such width in the preferred embodiment to be approximately twenty-four inches, a dimension slightly less than the length of web 4 so that the attachment of upper torso support 34 to mounting platform 8 would not interfere with the free rotation of foot support 20. Also, to accommodate the length of most operator feet (not shown), the length dimension of foot support 20 in the preferred embodiment would be approximately twelve to thirteen inches, a distance approximately one-fourth to one-third of the length dimension of base member 2, including anchors 10. FIG. 1 further shows the upper surface of foot support 20 laterally angled upward. In the preferred embodiment it is contemplated for each end of foot support 20 to be raised at identical fixed angles above its center, the fixed angle ranging approximately between 10–20°. Although the number of grooves 22 on walls 23 is not critical, it is contemplated for the preferred embodiment of the present invention to have approximately seven opposed sets of vertical grooves 22 in front of and behind the operator's feet, for use with bars 18 to narrow the width of the placement area for operator feet so that they can remain aligned with the operator's shoulders at all times during use.

Bars 18 provide a solid support structure on the outside of each operator foot during lower torso and leg rotation to permit the operator to achieve a fast but smooth repetitive rotational motion in both clockwise and counterclockwise directions. Optionally, although not shown, a mat made from a high-friction gripping type of material, or having a non-slip surface texture, or both, can be placed on the upper surface of foot support 20 during use to provide additional assistance in maintaining the operator's feet in a stationary position during lower torso and leg rotation.

Figure 4:
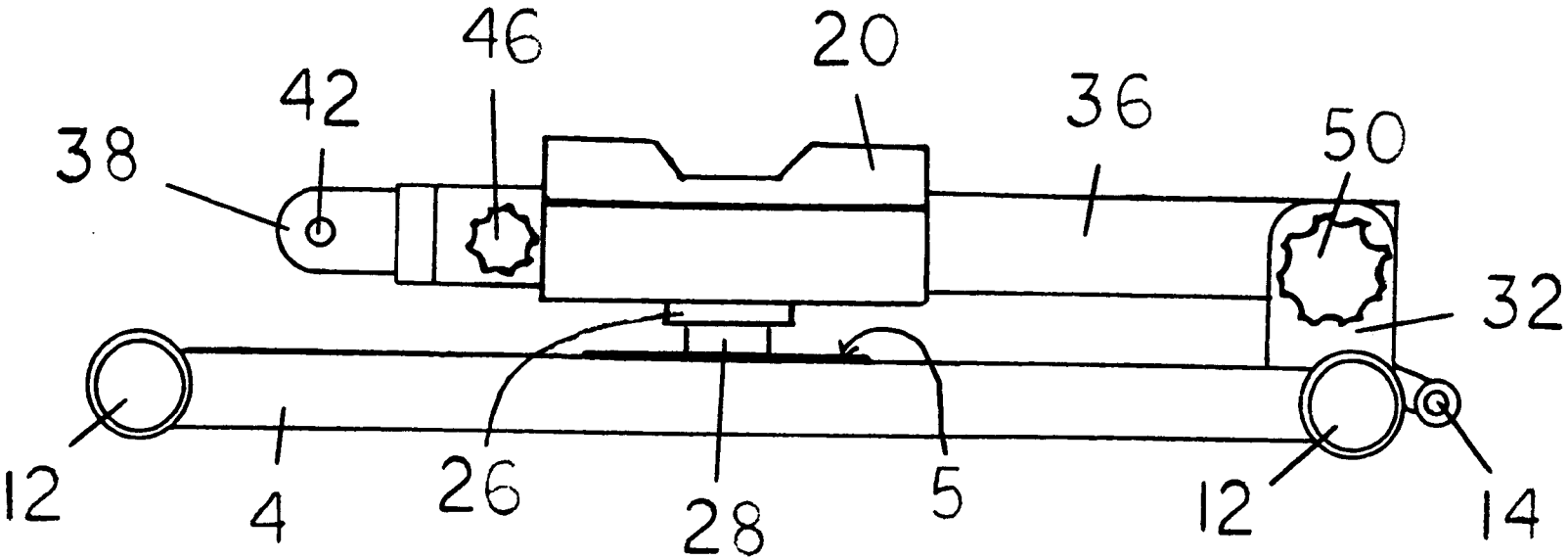
FIG. 4 is a side view of the preferred embodiment of the present invention in a collapsed configuration ready for storage.

FIG. 1 further shows the present invention having a vertically extending T-shaped adjustable upper torso support 34 with laterally extending handles 40 near to its distal end. Non-slip sleeves 42 made of a high-friction gripping type of material may be optionally placed over handles 40 to improve the grip of the operator's hands during lower torso and leg rotation. Although not shown and not critical to the present invention, an adhesive or bonding agent could be used to secure sleeves 42 to handles 40. In the preferred embodiment of the present invention it is contemplated for handles 40 to each have an elongated configuration and approximately the same length dimension. Also, although it is considered within the scope of the present invention for handles 40 to have different cross-sectional configurations, such as hexagonal or octagonal, in the preferred embodiment handles 40 would have a circular cross-sectional configuration. Both the height of upper torso support 34 and its angle relative to base member 2 are adjustable. This allows upper torso support 34 to be collapsed against base member 2 into a compact configuration for storage, as well as to be placed into various orientations between its collapsed configuration and a substantially vertical one for maximum comfort of the operator during lower torso and leg rotation. FIG. 1 further shows upper torso support 34 having an upper vertical support member 38 telescopingly engaged within the center bore 47 of lower vertical support member 36 for height adjustment of handles 40 so that they become positioned to allow the operator's arms to be approximately waist high during use. It is contemplated for holes 44 through at least one side of upper vertical support member 38 to engage with a protrusion, such as protrusion 60 in FIG. 2, extending from the proximal end of height adjustment knob 46 for locking upper vertical support member 38 in a secure fixed position relative to lower vertical support member 36 during lower torso and leg rotation. The number of holes 44 used is not critical, however, in the preferred embodiment approximately six or seven identically spaced-apart height adjustment holes 44 would be present. Also, although height adjustment knob 46 is shown in FIG. 1 to have an essentially circular cross-section, the size and shape of height adjustment knob 46 is not critical as long as it is configured for easy manipulation by an operator and secure engagement with holes 44. In addition, FIG. 1 shows lower vertical support member 36 pivotally connected to a U-shaped bracket 32 that is poised for attachment to mounting platform 8. Through rotation and counter-rotation of angle adjustment knob 50, the vertical orientation of lower vertical support member 36 may be changed to a position of maximum comfort for the operator (not shown), or upper torso support 34 may be collapsed against base member 2 for compact transport and storage of the present invention when not in use, as shown in FIG. 4. FIG. 1 also shows a non-slip mechanism 54 connected between U-shaped bracket 32 and lower vertical support member 36 that prevents sudden movement of lower vertical support member 36 should knob 50 somehow become loosened during lower torso and leg rotation. Although not shown, in some embodiments it is contemplated for angle adjustment knob 50 to comprise a spring for an easy pull and twist action in adjusting the angle of lower vertical support member 36 relative to base member 2. Angle adjustment knob 50 is shown in FIG. 1 to have an essentially circular cross-section, however it is contemplated for angle adjustment knob 50 to have any size and shape that allows easy operator manipulation. Although not required since in its collapsed horizontal storage and transport position lower vertical support member 36 is situated across foot support 20 between walls 23 and keeps foot support 20 in a substantially fixed position during transport, a temporary or permanent fastener, such as block 48, may optionally be attached to lower vertical support member 36 in a position that allows it to oppose rotation of freely rotatable foot support 20 during transport and storage. In the preferred embodiment, block 48 is made from a resilient material, such as a hard rubber compound or bendable plastic, that allows it to snap into place to engage foot support 20 without damaging the surface of foot support 20 or otherwise adversely affecting it.

FIG. 2 shows one preferred configuration of the height adjustment knob 46 used to secure lower vertical support member 36 to upper vertical support member 38 in a fixed position for safe operator use during foot support 20 rotation. Although the configuration shown in FIG. 2 is preferred, it is not critical and other height adjustment means that can secure upper vertical support member 38 into a fixed position relative to lower vertical support member 36 using holes 44 are also considered within the scope of the present invention. In the preferred embodiment shown in FIG. 2, height adjustment knob 46 is connected to one end of an externally threaded shaft 56 and an outwardly biased protrusion 60 extends through the other end of shaft 56. A spring positioned within shaft 56, such as spring 62, provides the outward biasing of protrusion 60 that causes protrusion 60 to securely engage each hole 44 with which it comes in contact during height adjustment of upper vertical support member 38. Also in the preferred embodiment of the present invention, a mounting receptacle 58 having female threads complementing those of shaft 56 is attached to lower vertical support member 36 to provide a means of engagement for shaft 56 with lower vertical support member 36. The essentially circular cross-section of height adjustment knob 46 shown in FIG. 2 is preferred but not critical, and it is considered within the scope of the present invention for height adjustment knob 46 to be otherwise configured as long as it is a comfortable size and shape for easy manipulation by an operator hand. The material from which height adjustment knob 46 is made is also not critical, although in the present invention height adjustment knob 46 would preferably be made from metal or a hard plastic.

FIG. 3 shows one preferred embodiment of the pivotal connection between lower vertical support member 36 and U-shaped bracket 32 in the present invention. Although not shown or identified in FIG. 3, U-shaped bracket 32 has an opening centrally positioned through both of its sides with a diameter slightly larger than the outside diameter dimension of bolt 52. Lower vertical support member 36 also has openings through two of its opposed sides at a distance from its lower end that permits alignment with the openings in U-shaped bracket 32 for pivotal movement of lower vertical support member 36 between substantially vertical and horizontal positions. The diameters of both openings in lower vertical support member 36 are also each slightly larger than the outside diameter dimension of bolt 52. FIG. 3 shows elongated bolt 52 having a threaded distal end inserted centrally through a first side of U-shaped bracket 32, a spacer 64 positioned between the first side of U-shaped bracket 32 and the proximal outer surface of lower vertical support member 36, lower vertical support member 36, a two-part multiple angle slip-resistant mechanism 54 positioned between the opposed outer surface of lower vertical support member 36 and the second side of U-shaped bracket 32, and ultimately engaging angle adjustment knob 50. It is not critical whether external threads 56 are present only on the distal half of bolt 52 or whether the entire outer surface of its shaft has a threaded configuration. Also, in the preferred embodiment, although not critical, it is contemplated for spacer 64 to be made of a durable material, such as metal, and permanently attached to the outside surface of lower vertical support member 36 by welding or bonding compounds. It is also contemplated for one part of slip-resistant mechanism 54 to be secured to the outside surface of lower vertical support member 36 and the remaining part of slip-resistant mechanism 54 to be secured to the inside surface of the second side of U-shaped bracket 32. Although not critical, in the preferred embodiment secure attachment of slip-resistant mechanism 54 to lower vertical support member 36 and U-shaped bracket 32 can be achieved through welding or bonding compounds. Although in the preferred embodiment slip-resistant mechanism 54 has a plurality of teeth on the surfaces of its two parts that are contemplated for contact with one another during use, other multiple angle slip-resistant configurations would also be considered within the scope of the present invention. Also, the configuration of angle adjustment knob 50 in the preferred embodiment permits angle adjustment of lower vertical support member 36 relative to U-shaped bracket 32 through a slight rotation of angle adjustment knob 50, without having to completely remove angle adjustment knob 50 from the distal end of bolt 52.

FIG. 4 shows the preferred embodiment of the present invention in its fully collapsed position ready for convenient transport or storage. Web 4 is positioned between the two anchors 10, the ends of which are each covered with a cap 12. Web 4 is also oriented in an essentially horizontal position, which places visible wheel 14, and the one or more wheels 14 hidden behind visible wheel 14 and aligned with it, in raised positions unavailable for use during lower torso and leg rotation. However, wheels 14 are oriented so that when the anchor 10 remote from U-shaped bracket 32 is raised upwardly into a position similar to that used to transport a dolly or handtruck (not shown), wheels 14 become engaged with the floor surface (not shown) below base member 2 and allow easy balanced movement of the present invention from one location to another. FIG. 4 further shows extension 26 downwardly depending from the bottom surface of foot support 20 centrally connected within a bearing cartridge 28 that is secured in place by a support plate 5 attached to the top surface of central web 4. FIG. 4 also shows lower vertical support member 36 in an essentially horizontal position resting on the upper portion of foot support 20. The proximal end of lower vertical support member 36 is pivotally connected to U-shaped bracket 32 with angle adjusting knob 50 configured for convenient operator access and use. In addition, FIG. 4 shows upper vertical support member 38 in a retracted position within the distal end of lower vertical support member 36, height adjusting knob 46 near the distal end of lower vertical support member 36, and handle sleeve 42 near the distal end of upper vertical support member 38. Optional foot support 20 retaining block 48 is not shown in FIG. 4.

Figure 5:
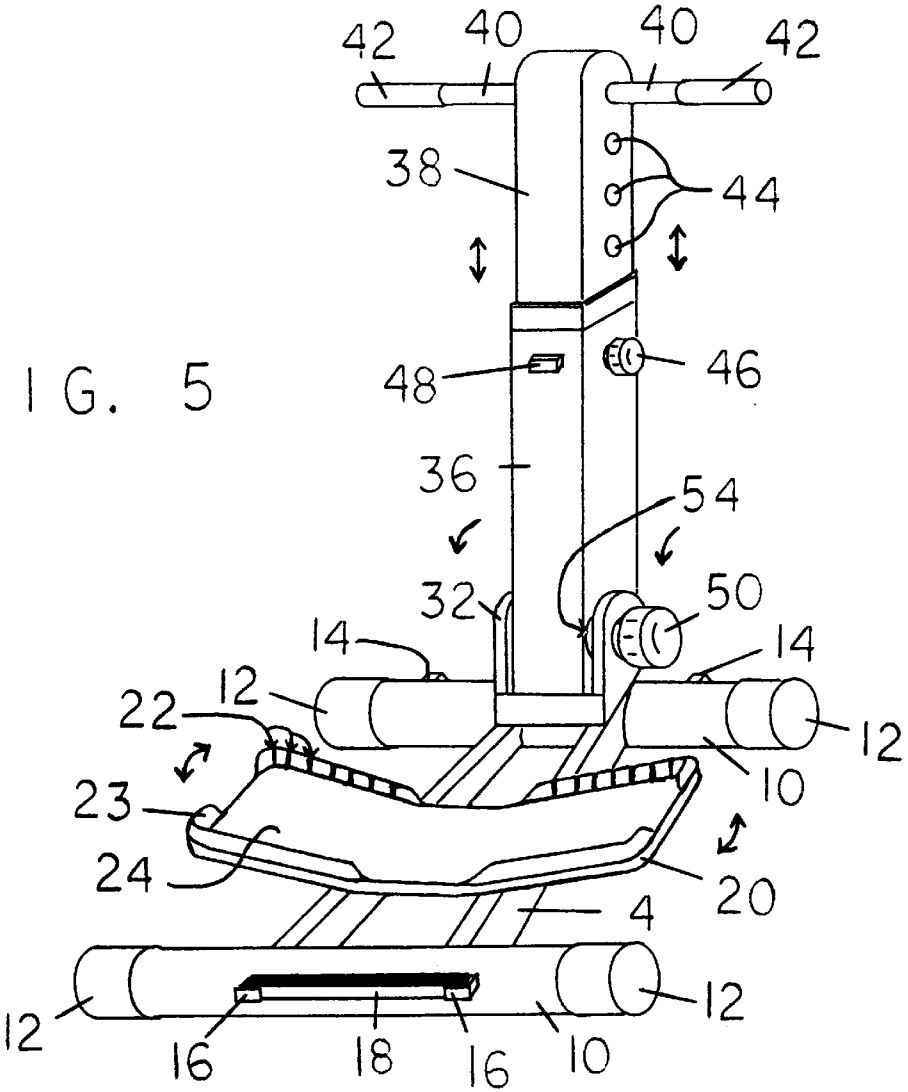
FIG. 5 is a perspective view of the first preferred embodiment of the present invention in an assembled condition ready for use, with its a freely rotatable foot support and its adjustable upper torso support each attached to its base member.

FIG. 5 shows the preferred embodiment of the present invention in one of its fully expanded positions ready for use. Web 4 is connected between two elongated anchors 10 with the opposite ends of each anchor 10 covered by a cap 12 made from a non-skid, gripping type of material. Foot support 20 is centrally positioned upon the top surface of web 4 for free rotation in both clockwise and counterclockwise directions, as indicated by the arrows near to the opposite ends of foot support 20. The support plate 5 shown in FIG. 1 positioned across the top surface of web 4 is hidden from view in FIG. 5. FIG. 5 also shows foot support 20 having an upper surface 24 for placement of operator feet (not shown) and a plurality of spaced-apart vertically oriented grooves 22 on the inside surface of perimeter walls 23 for insertion of rigid bars 18 to narrow the width of foot support 20 during use so that the outside edge of the operator's feet will be in contact with rigid bars 18 during lower torso rotation for improved operator balance and stability, and a smoother torso twisting motion. When not in use, rigid bars 18 in the preferred embodiment are supported by brackets 16 secured to the anchor 10 remote from U-shaped bracket 32. FIG. 5 further shows wheels 14 attached to the anchor 10 adjacent to U-shaped bracket 32 and available for use in transporting the present invention from one location to another when the present invention is upended like a dolly or handtruck (not shown). In addition, FIG. 5 shows lower vertical support member 36 secured within U-shaped bracket 32 and oriented in a substantially vertical position. A portion of non-slip mechanism 54 is visible between lower vertical support member 36 and U-shaped bracket 32. Arrows show the direction of movement of lower vertical support member 36 to achieve its compact collapsed storage and transport position. Angle adjustment knob 50 is located near to the bottom end of lower vertical support member 36 and configured for easy operator use. Upper vertical support member 38 is telescopingly inserted within the upper end of lower vertical support member 36 with holes 44 and height adjusting knob 46 available for use in placing upper vertical support member 38 and lower vertical support member 36 in various fixed positions relative to one another. Arrows show the upward and downward direction of movement possible for upper vertical support member 38. FIG. 5 also shows elongated handles 40 extending from opposites sides of upper vertical support member 38 near to its top end, and sleeves 42 made from gripping material attached over the ends of handles 40. FIG. 5 also shows the optional retaining block 48 for foot support 20 attached to the lower vertical support member 36 near to its top end.

Although not shown in the illustrations provided herein, it is also contemplated for a timer or clock to be optionally attached to upper torso support 34 in a convenient position for ease of viewing by the operator for timing the duration of lower torso and leg rotation. Preferably such a clock or timer would be attached to the top end of upper vertical support member 38 above the uppermost hole 44, and in a position that doesn't interfere with the collapse of upper torso support into its compact storage and transport configuration. Also, in the preferred embodiment base member 2, upper torso support 34, and rotatable foot support 20 would be made from strong, durable, low-maintenance materials, such as steel, which can be protected from corrosion by paint or other coating materials. Further, the H-shaped configuration of base member 2 is preferred but not critical and other variations in the configuration are within the scope of the present invention as long as they also provide a stable, anchored structure for upper torso support 34 and against which foot support 20 can freely rotate.

For illustrative purposes only, dimensions are provided below for some of the components in the preferred embodiment of the present invention. However, it should be noted that although the following dimensions are suggested for the preferred embodiment, other embodiments with one or more differing dimensions are also considered within the scope of the present invention. For example, the foot support 20 of the preferred embodiment would have an upper surface 24 with a length dimensions between twelve and thirteen inches, and a width dimension of approximately twenty-four inches. Walls 23 around the perimeter of foot support 20 would have vertically extending grooves 22 that are approximately one-and-one-half inches in height, approximately three-fourths of an inch apart, and approximately one-fourth of an inch in depth. Bars 18 in the preferred embodiment would have length, width, and thickness dimensions of approximately thirteen-and-one-fourth inches, one-and-one-fourth inches, and three-sixteenths of an inch, respectively. Further, the overall front to back length dimension of the preferred embodiment of the present invention would be approximately thirty-four inches with the length dimension of anchors 10 each being approximately twenty-six inches. Base member 2 would be approximately three inches in height, and have two wheels 14 attached to the anchor 10 positioned adjacent to mounting plate 8, each wheel 14 being approximately one-and-one-half inches in diameter and mounted to anchor 10 approximately four inches from one of its opposite ends. Also, in the preferred embodiment of the present invention lower vertical support member 36 would be approximately thirty inches in length and approximately three inches square, with upper vertical support member being approximately twenty-four inches in length and two-and-one-fourth inches square, and U-shaped bracket 32 would have an internal space approximately four inches square. In addition, handles 40 attached to upper vertical support member 38 would have a circular cross-section approximately one inch in diameter and in combination the two handles 40 would have a total length of twenty-two inches. In the preferred embodiment sleeves 42 would be also made from a durable foam material having a thickness dimension of approximately one-fourth of an inch. Further, in the preferred embodiment there would be six or seven holes 44 in upper vertical support member 38 each approximately three-eighths of an inch in diameter, and holes 44 would be spaced apart at intervals of approximately two inches. Holes 44 should not be too numerous or large that they risk weakening upper vertical support member 38. Further, in the preferred embodiment vertical adjustment knob 46 would have a diameter dimension of approximately two inches, while angle adjustment knob 50 would have a diameter dimension of approximately three inches.

The present invention is simple to use and beginners are not at a disadvantage. Once an operator (not shown) uses the rotating knobs 46 and 50 on lower vertical support member 36, to adjust the angle of the lower vertical support member 36 relative to base member 2, as well as the height of upper vertical support member 38 for his or her maximum comfort, the rigid bars 18 stored within brackets 16 attached to base member 2, if needed, would optionally be positioned within vertically extending grooves 22 of foot support 20 so that when the operator's feet (not shown) are aligned with his or her shoulders, the outside edge of each foot rests against one of the rigid bars 18. The operator would then stand behind the rear anchor 10 with foot support 20 approximately parallel to anchor 10, lean over foot support 20 and grab onto handles 40 with his or her hands. While using handles 40 for upper torso support, the operator would then mount foot support 20 by placing one foot at a time near the center of freely rotating foot support 20. Thereafter, the operator would move one foot at a time from the center of foot support 20 into a position where its outer edge is in contact with one of the rigid bars 18, or walls 23 if such a position will allow the operator's feet to remain aligned with his or her shoulders. Then, with knees and/or arms slightly bent or straight as needed to closely mimic athlete movement in the sport for which improved performance is desired, the operator would begin twisting his or her lower torso and legs as a unit from side to side without torso sway to make foot support 20 rotate alternatively in clockwise and counterclockwise directions while the operator's upper torso remains in a substantially stationary straightforward position. As the operator's flexibility improves, twisting of foot support 20 approximately 180° or more would be anticipated in each direction. Use of the present invention for at least fifteen to twenty minutes every day is recommended to improve and maintain a high level of operator flexibility, and thereby enhance operator balance as well as swinging, throwing, punching, and forward thrusting power during sports activity. To dismount the present invention, with foot support 20 again in a position approximately parallel to anchor 10 an operator would continue to hold onto handles 40 while moving one foot at a time toward the center of foot support 20. Thereafter, the operator would move one foot at a time backwards off upper surface 24 and onto the floor (not shown) behind rear anchor 10. Once the operator's feet are clear of the apparatus, the operator's hands may be released from handles 40.

What is claimed is:

1. An exercise apparatus which allows rapid, smooth, and repetitive lower torso and leg rotation without sway through an arc of approximately 180° in each direction to provide a high number of muscle movement repetitions in a short period of time for conditioning and toning of targeted operator muscles to give them the level of movement experience necessary for improved sports performance as well as enhance operator balance, agility, and forward thrusting power, said apparatus comprising width-adjustable foot support means having an upper surface laterally angled upward for positioning an operator's feet in an orientation wherein a major portion of the operator's weight is alternatively placed on the inside bottom surface of each operator foot when said foot support means is rotated and for also providing variably positioned hard surfaces against which operators of differing stature can place the outside edge of each of their feet to cause the feet to remain in a stationary position aligned with the operator's shoulders during foot support rotation;

height-adjustable upper torso support means for providing elongated handles at waist height that an operator can use to maintain his or her upper torso in a substantially stationary straightforward position during rotation of said foot support means;

base support means for providing a stationary support structure upon which said foot support means can be attached for free rotation in both clockwise and counterclockwise directions and to which said upper torso support means can be pivotally mounted;

rotational connection means for connecting said foot support means to said base support means; and pivotal connection means for connecting said upper torso support means to said base support means so that when an operator is positioned upon said foot support means said handles can be adjusted according to the stature of the operator so that said handles are positioned at a height near to the operator's waist, the operator's hands can grip said handles and with bent knees cause said foot support means to rotate so as to duplicate actual sports activity movement typical to many sports to give arm, shoulder, hip, back, leg, and foot muscles in a short period of time the level of movement experience necessary for improved sports performance.

2. The apparatus of claim 1 wherein said base support means comprises an H-shaped base member, and wherein said rotational connection means comprises a bearing cartridge fixedly supported by said base member, and a ring clamp for securing said foot support means rotatably to said bearing cartridge.

3. The apparatus of claim 2 wherein said base support means further comprises a substantially rectangular web having end surfaces, an elongated anchor with opposed ends attached symmetrically to each of said end surfaces, and non-slip caps attached over each of said opposed ends.

4. The apparatus of claim 1 wherein said foot support means comprises a substantially rectangular foot support with an upper surface having a perimeter, a plurality of side walls around said perimeter, a plurality of vertically extending grooves on said side walls, and a plurality of rigid bars for removable engagement with said grooves.

5. The apparatus of claim 1 wherein said pivotal connection means comprises a U-shaped bracket, a bolt with a threaded distal end, a multiple angle non-slip mechanism, and an angle adjusting knob with internal threads for engaging said distal end.

6. The apparatus of claim 1 wherein said upper torso support means comprises an upper vertical support member, a lower vertical support member, a plurality of holes in said upper vertical support member, and a height-adjusting knob with an outwardly biased protrusion configured to securely engage each of said holes when said protrusion is in contact therewith.

7. The apparatus of claim 1 wherein each of said handles has a distal end, and said upper torso support means further comprises a grip-enhancing sleeve attached over each of said distal ends.

8. The apparatus of claim 1 wherein said upper torso support means further comprises at least one retaining block configured for contact with said foot support means to prevent rotation of said foot support means during transport and storage of said apparatus while said upper torso support means is pivoted into a substantially horizontal position against said foot support means, and wherein said base support means also comprises a base member and a plurality of wheels configured for easy transport of said apparatus when said apparatus is upended like a dolly, said wheels being attached to said base member so as to engage a floor surface under said base member only when said apparatus is upended like a dolly.

9. The apparatus of claim 1 wherein said upper surface of said foot support means is angled laterally upward at a fixed angle between 10° and 20°.

10. An exercise apparatus which allows rapid, smooth, and repetitive lower torso and legs rotation without sway through an arc of approximately 180° in each direction to provide a high number of muscle movement repetitions in a short period of time for conditioning and toning of targeted operator muscles to give them the level of movement experience necessary for improved sports performance as well as enhance operator balance, agility, and forward thrusting power, said apparatus comprising width-adjustable foot support means having an upper surface laterally angled upward at a fixed angle between 10° and 20° for positioning an operator's feet in an orientation wherein a major portion of the operator's weight is alternatively placed on the inside bottom surface of each operator foot when said foot support means is rotated and for also providing variably positioned hard surfaces against which operators of differing stature can place the outside edge of each of their feet to cause the feet to remain in a stationary position aligned with the operator's shoulders during foot support rotation;

height-adjustable upper torso support means for providing elongated handles at waist height that an operator can use to maintain his or her upper torso in a substantially stationary straightforward position during rotation of said foot support means;

base support means for providing a stationary support structure upon which said foot support means can be attached for free rotation in both clockwise and counterclockwise directions and to which said upper torso support means can be pivotally mounted, said base support means comprising an H-shaped base member with a substantially rectangular web having end surfaces and an elongated anchor with opposed ends symmetrically attached to each of said end surfaces;

rotational connection means for connecting said foot support means to said base support means, said rotational connection means comprising a bearing cartridge fixedly supported by said base member, and a ring clamp for securing said foot support means rotatably to said bearing cartridge; and pivotal connection means for connecting said upper torso support means to said base support means so that when an operator is positioned upon said foot support means said handles can be adjusted according to the stature of the operator so that said handles are positioned at a height near to the operator's waist, the operator's hands can grip said handles and with bent knees cause said foot support means to rotate so as to duplicate actual sports activity movement typical to many sports to give arm, shoulder, hip, back, leg, and foot muscles in a short period of time the level of movement experience necessary for improved sports performance.

11. The apparatus of claim 10 wherein said foot support means comprises a substantially rectangular foot support with an upper surface having a perimeter, a plurality of side walls around said perimeter, a plurality of vertically extending grooves on said side walls, and a plurality of rigid bars for removable engagement with said grooves.

12. The apparatus of claim 10 wherein said pivotal connection means comprises a U-shaped bracket, a bolt with a threaded distal end, a multiple angle non-slip mechanism, and an angle adjusting knob with internal threads for engaging said distal end.

13. The apparatus of claim 10 wherein said upper torso support means comprises an upper vertical support member, a lower vertical support member, holes in said upper vertical support member, and a height-adjusting knob with an outwardly biased protrusion configured to securely engage each of said holes when said protrusion is in contact therewith.

14. The apparatus of claim 10 wherein said base support means also comprises a base member and a plurality of wheels configured for easy transport of said apparatus when said apparatus is upended like a dolly, said wheels being attached to said base member so as to engage a floor surface under said base member only when said apparatus is upended like a dolly.

15. The apparatus of claim 10 wherein said upper torso support means further comprises at least one retaining block configured for contact with said foot support means to prevent rotation of said foot support means during transport and storage of said apparatus while said upper torso support means is pivoted into a substantially horizontal position against said foot support means.

16. The apparatus of claim 10 wherein each of said handles has a distal end, and said upper torso support means further comprises a grip-enhancing sleeve attached over each of said distal ends, and wherein said base support means further comprises a non-slip cap attached over each of said opposed ends of said anchors.

17. A method for causing rapid, smooth, and repetitive lower torso and legs rotation without sway through alternative arcs of approximately 180° in both clockwise and counterclockwise directions to provide a high number of repetitions of muscle movement in a short period of time that duplicate muscle movement during actual sports performance for conditioning and toning of targeted operator muscles to give such muscles the movement experience necessary for improved sports performance as well as enhance operator balance, agility, and forward thrusting power, said method comprising the steps of providing an exercise apparatus having two rigid bars; a freely rotatable foot support that is laterally angled upward from its center, attached to a stationary base member with a central web extending between two end anchors, and has side walls with a plurality of vertically extending grooves therein, said exercise apparatus also having an upper torso support pivotally connected to said base support, said upper torso support having a lower vertical support member, and an upper vertical support member with a top end and two elongated handles attached to said top end;

adjusting the angle of said upper torso support relative to said base member according to the stature and ease of use preference of the operator;

adjusting the height of said upper vertical support member relative to said lower vertical support member so that said handles are positioned approximately at the height of the operator's waist;

optionally using said rigid bars if needed to narrow the width of said foot support to a width approximating the width of the operator's shoulders;

the operator standing behind said exercise apparatus, and with said foot support in a position approximately parallel to said end anchors leaning over said foot support, and using each hand to grasp one of said handles;

while using said handles for upper torso support, the operator mounting said foot support by placing one foot at a time near the center of said freely rotating foot support;

the operator moving one foot at a time from the center of said foot support onto said portion of said foot support that is laterally angled upward to position the operator's feet in an orientation wherein a major portion of the operator's weight is alternatively placed on the inside bottom surface of each operator foot when said foot support means is rotated and also position operator feet into positions where the outer edge of each foot is aligned with his or her shoulders and simultaneously in contact with one of said rigid bars or said walls;

the operator with knees slightly bent then causing said foot support and his or her lower torso and legs to twist from side to side without torso sway alternatively in clockwise and counterclockwise directions in a maximum arc of approximately 180° while the operator's upper torso remains in a substantially stationary straightforward position;

after use for a predetermined amount of time intended to enhance operator performance in a targeted sport, and with said foot support in a position approximately parallel to said end anchors, the operator then dismounting from said exercise apparatus by moving one foot at a time off of said upwardly angled lateral portion of said foot support toward the center of said foot support while simultaneously keeping both hands connected to said handles;

the operator then moving one foot at a time backwards off of said foot support; and the operator then releasing his or her hands from said handles.

18. The method of claim 17 further comprising the steps of providing an exercise apparatus having a bearing cartridge fixedly supported by said base member and a ring clamp for securing said foot support means rotatably to said bearing cartridge.

19. The method of claim 17 further comprising the step of providing an exercise apparatus having a foot support laterally angled approximately 10–20°.

20. The method of claim 17 wherein the step of the operator causing said foot support to rotate alternatively in clockwise and counterclockwise directions further comprises rotation for a period of time ranging between approximately fifteen and twenty minutes.

* * * * *